US005887947A

United States Patent [19]

Chi

[11] Patent Number: 5,887,947

[45] Date of Patent: Mar. 30, 1999

[54] CHAIR HAVING SEAT THAT CAN BE ELEVATED AND INCLINED

[76] Inventor: Shaw-Tsong Chi, P.O. Box 453, Taichung, Taiwan

[21] Appl. No.: 5,111

[22] Filed: Jan. 9, 1998

[51] Int. Cl.[6] ..... A47C 1/022

[52] U.S. Cl. ..... 279/337; 297/338

[58] Field of Search ..... 297/337, 338, 297/332, 16.1, 16.2, 19, 58, 313

[56] References Cited

U.S. PATENT DOCUMENTS

| | | | |
|---|---|---|---|
| 3,181,828 | 5/1965 | Cramer | 297/338 X |
| 4,148,523 | 4/1979 | Brand et al. | 297/338 X |
| 4,793,654 | 12/1988 | Takafuji | 297/338 |
| 5,167,436 | 12/1992 | Wu | 297/338 |
| 5,511,855 | 4/1996 | Miles | 297/338 X |
| 5,609,390 | 3/1997 | Takafuji | 297/338 X |
| 5,702,158 | 12/1997 | Mengshoel et al. | 297/338 X |

FOREIGN PATENT DOCUMENTS

| | | | |
|---|---|---|---|
| 555850 | 3/1931 | Germany | 297/338 |

*Primary Examiner*—Jose V. Chen
*Assistant Examiner*—Rodney B. White
*Attorney, Agent, or Firm*—Harrison & Egbert

[57] ABSTRACT

A chair having a frame work with of two main posts, two bracing posts, and an adjustable seat frame. Two main posts are braced by a bottom slat and provided with pivoting holes and locating holes. Two bracing posts are connected by a base slat and are fastened respectively at the top end thereof with the pivoting holes of the main posts. The seat frame has an elevation rod and an inclination rod for adjusting respectively the height and the inclination of a seat of the seat frame.

1 Claim, 5 Drawing Sheets

CHAIR HAVING SEAT THAT CAN BE ELEVATED AND INCLINED

FIELD OF THE INVENTION

The present invention relates generally to a chair, and more particularly to a chair having a seat that can be elevated and inclined to afford a sitting comfort.

BACKGROUND OF THE INVENTION

There are a variety of conventional chairs, which are provided with a seat that can be neither elevated nor inclined to suit a person's need. As a result, the conventional chairs of all sorts often fail to provide a person seated thereon a sitting comfort.

SUMMARY OF THE INVENTION

The primary objective of the present invention is therefore to provide an innovative chair having a seat which can be adjusted in height and inclination.

In keeping with the principle of the present invention, the foregoing objective of the present invention is attained by a chair having a framework which has two main posts, two bracing posts, and an adjustable seat frame. Two main posts are braced by a bottom slat and provided with pivoting holes and locating holes. The two bracing posts are connected by a base slat and are fastened respectively at the top end thereof with the pivoting holes of the main posts. The seat frame comprises an elevation rod and an inclination rod for adjusting the height and the inclination of the seat frame.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
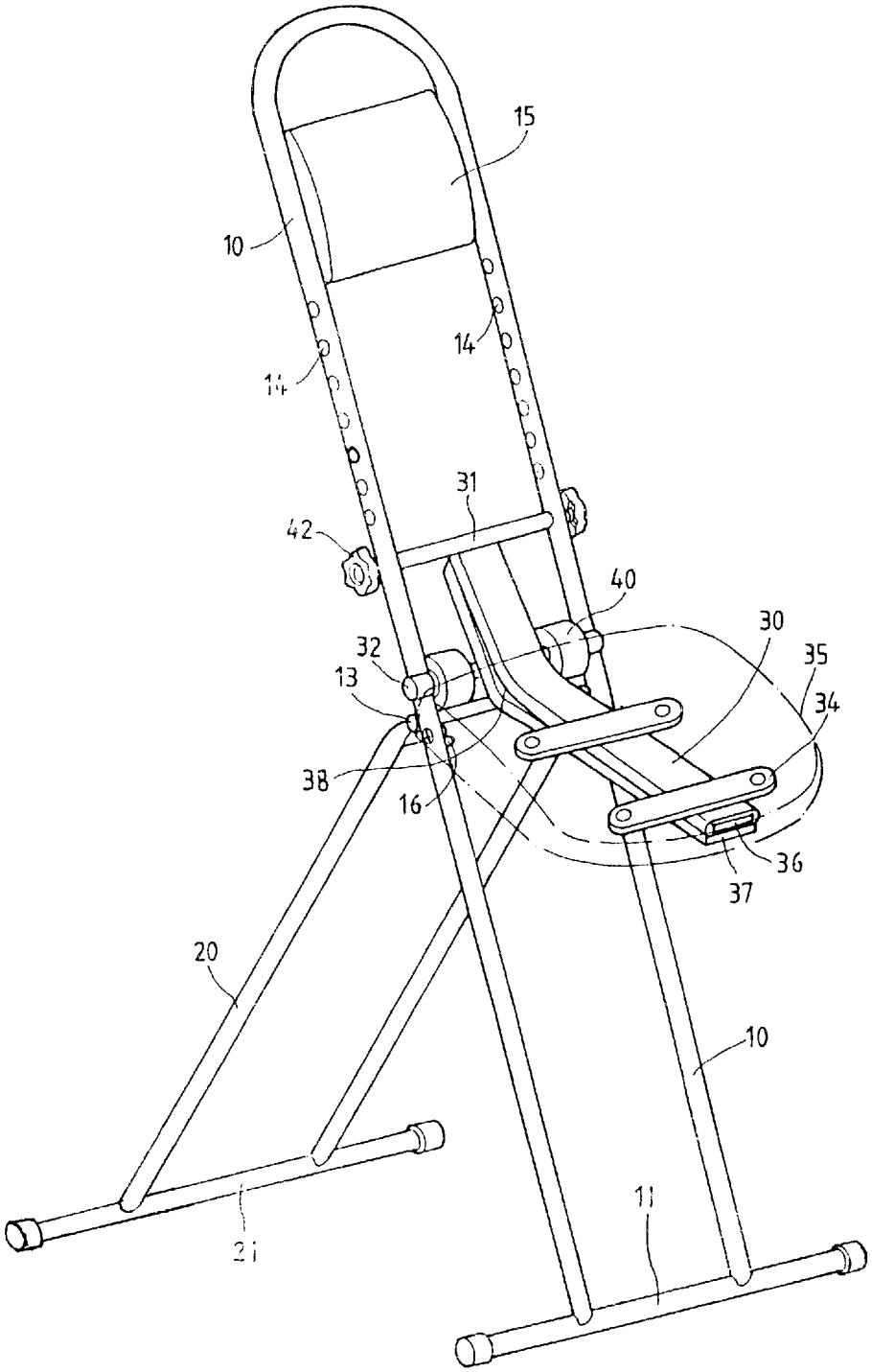
FIG. 1 shows a perspective view of the embodiment of the present invention.
Figure 2:
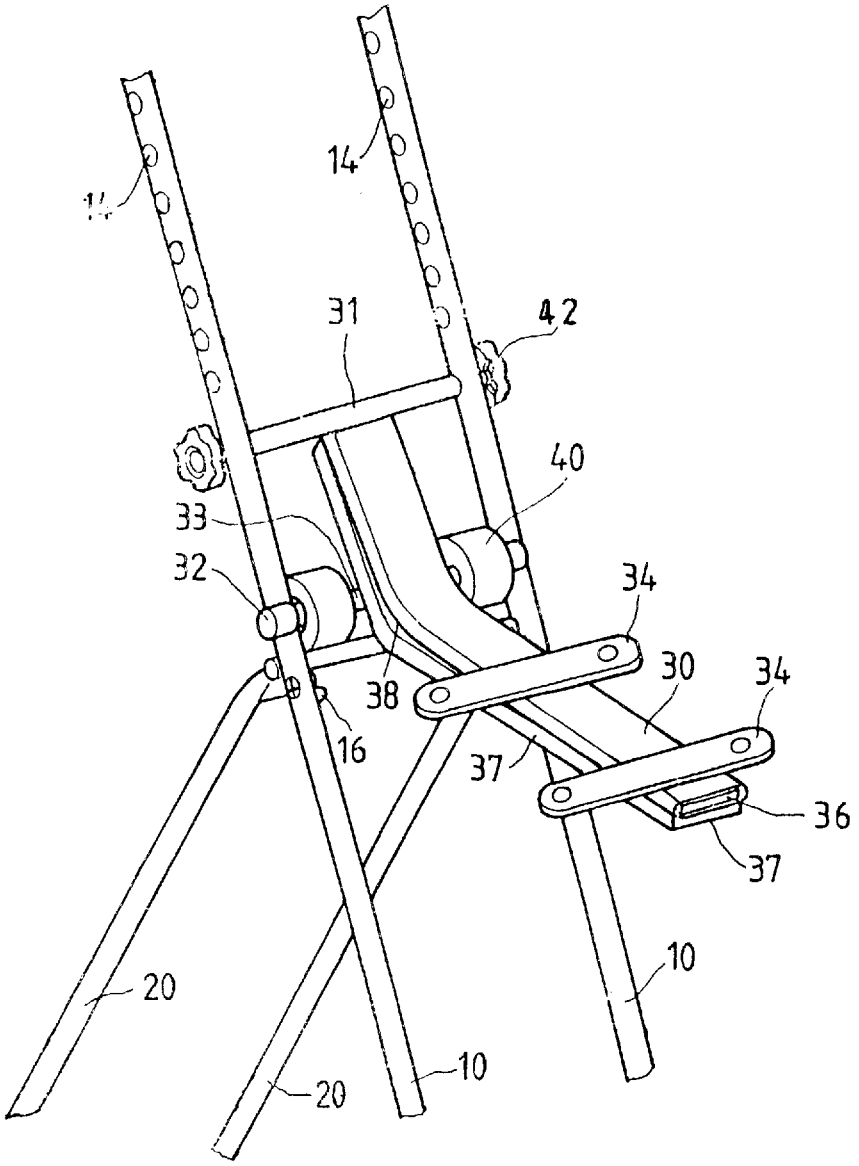
FIG. 2 shows another perspective view of the embodiment of the present invention.
Figure 3:
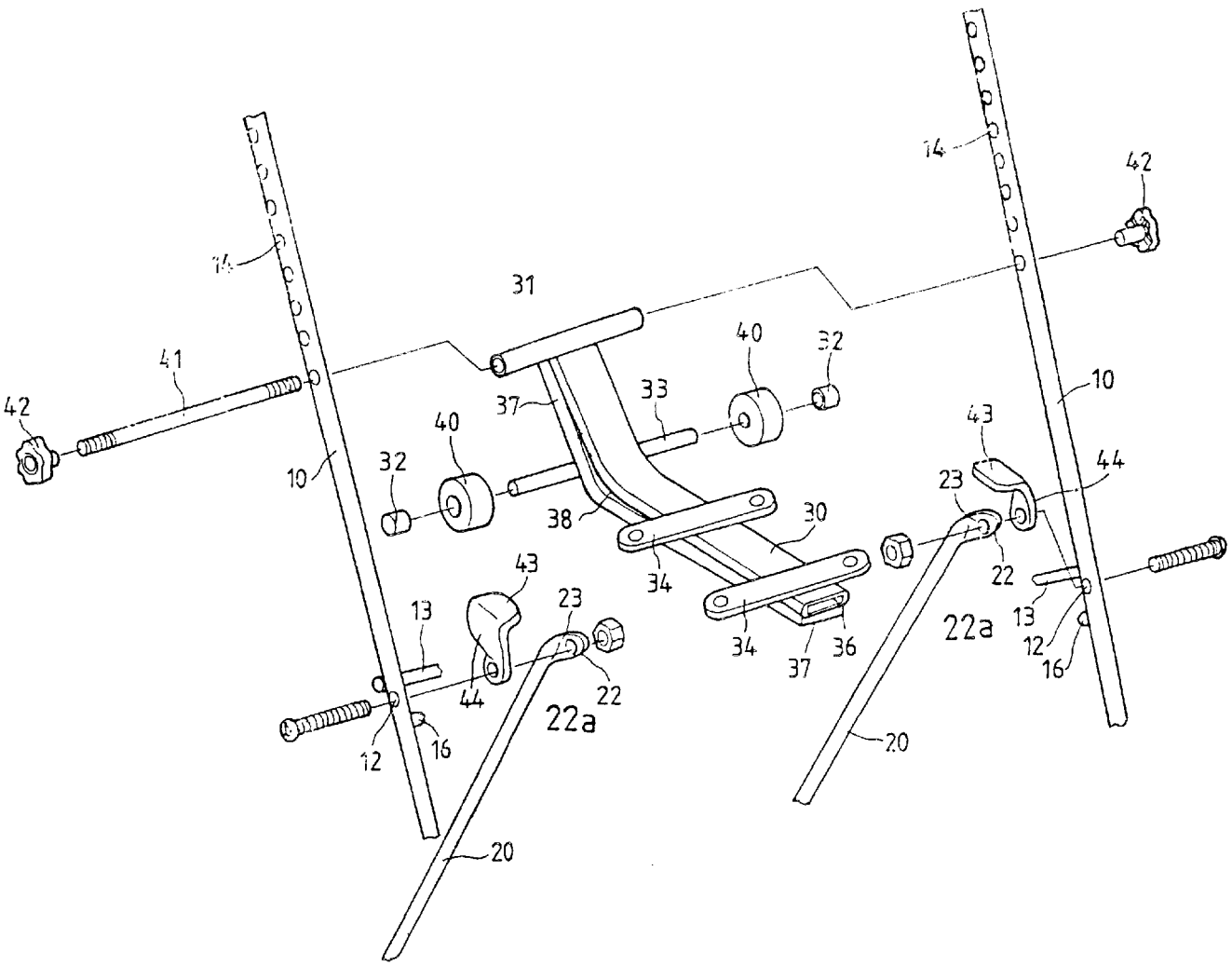
FIG. 3 shows a partial exploded view of the embodiment of the present invention.
Figure 4:
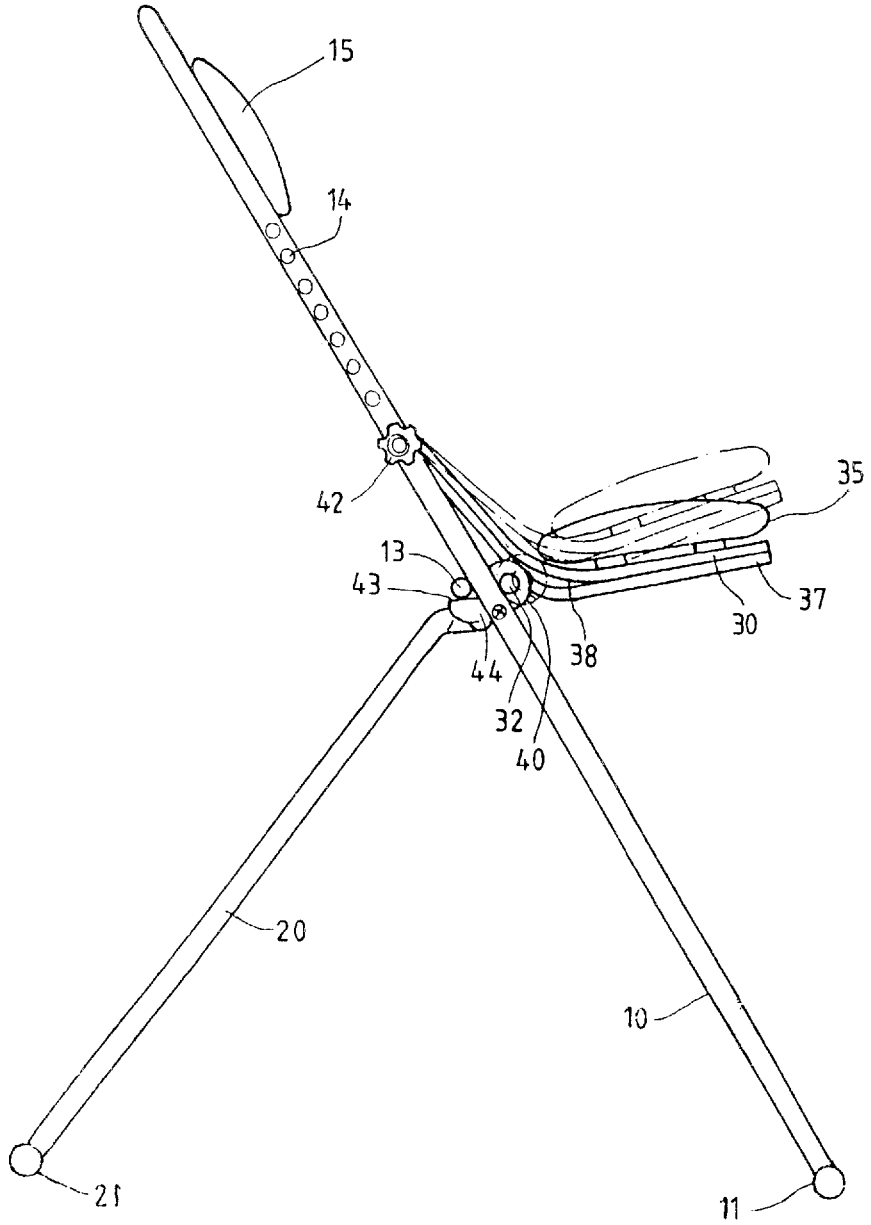
FIG. 4 shows a side schematic view of the embodiment of the present invention.
Figure 5:
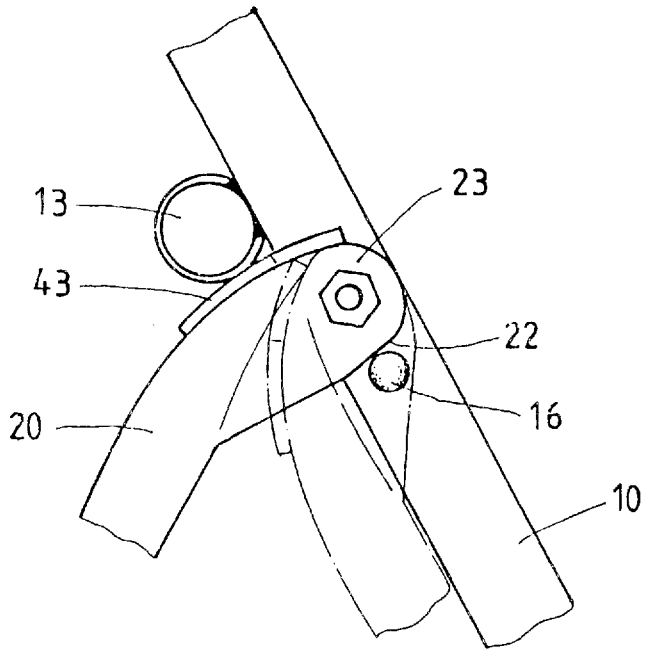
FIG. 5 shows a partial schematic plan view of the embodiment of the present invention.
Figure 6:
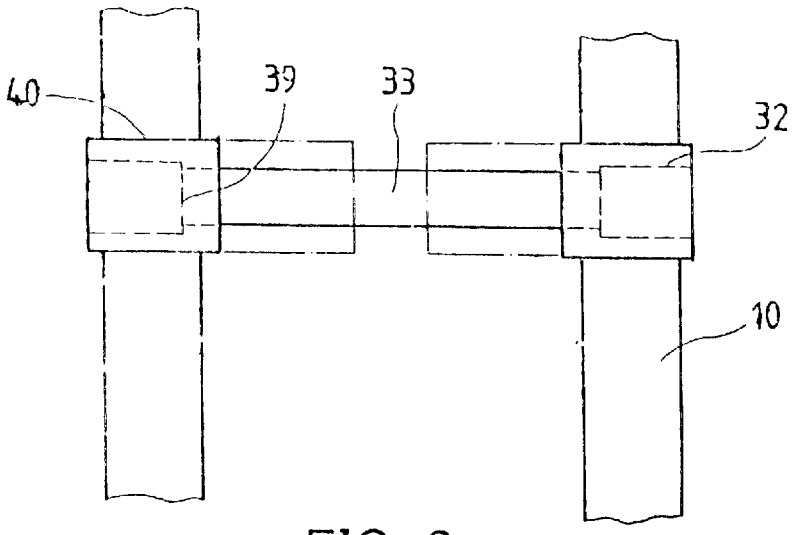
FIG. 6 shows another partial schematic plan view of the embodiment of the present invention.

As shown in FIGS. 1–3, a chair embodied in the present invention is mainly composed of two main posts 10, two bracing posts 20, and a seat frame 30.

Two main posts 10 are connected by a horizontal bottom slat 11 and are provided respectively and correspondingly with a pivoting hole 12 and a plurality of locating holes 14. A backrest 15 is attached to the two main posts 10. Located under the pivoting hole 12 is a locating protuberance 16. A horizontal bar 13 is fastened between the two main posts 10 such that the horizontal bar 13 is located over the pivoting holes 12 of the main posts 10.

Two bracing posts 20 are connected at the bottom ends thereof by a base slat 21 and are provided respectively at the top end thereof with a pivoting end 23 having a locating edge 22 and a 22*a*. The bracing posts 20 are fastened pivotally with the pivoting holes 12 of the main posts 10 by means of bolts engaging the pivoting holes 12 of the main posts 10 and the fastening holes of the bracing posts 20.

The seat frame 30 is provided at the top thereof with an elevation rod 31 fastened therewith. Located under the elevation rod 31 is an inclination rod 33 parallel to the elevation rod 31 which is hollow and provided therein with a fastening rod 41 for engaging the locating holes 14 of the two main posts 10. The fastening rod 31 is fastened with the main posts 10 by two fastening nuts 42 after the seat frame 30 is located at a desired height. The seat frame 30 is further provided with a plurality of seat supports 34 on which a seat 35 is mounted. The seat frame 30 is reinforced by an inner reinforcing plate 36, an auxiliary reinforcing plate 37, and a curved reinforcing plate 38. The inclination rod 33 is provided respectively at both ends thereof with a fitting piece 32 and a sleeve 40 having an inner edge 39.

It must be noted here that a lug 44 is located between the pivoting end 23 and the pivoting hole 12. The lug 44 has a stop plate 43 and is intended to prevent the mechanical friction between the main post 10 and the bracing post 20.

In combination, the locating protuberance 16 is located under the pivoting hole 12 such that the locating protuberance 16 is in contract with the locating edge 22 of the pivoting end 23. The seat frame 30 can be adjusted in height by relocating the elevation rod 31. The seat 35 can be caused to incline by sliding the sleeve 40 on the fitting piece 32 of the inclination rod 33 such that the sleeve 40 is pressed against the main post 10.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A chair having a seat that can be elevated and inclined, the chair comprising:

two main posts connected together by a horizontal bottom slat and provided respectively and correspondingly with a plurality of locating holes and a pivoting hole, said main posts having a backrest fastened thereto, said main posts each having a locating protuberance located under said pivoting hole, said main posts having a horizontal bar fastened therebetween;

two bracing posts connected at bottom ends thereof by a base slat, said bracing posts each having a pivoting end at a top end thereof, each of said bracing posts having a locating edge and a fastening hole, said bracing posts being fastened pivotally to said main posts respectively by fastening bolts which are engaged with said pivoting holes of said main posts and with said fastening holes of said bracing posts; and a seat frame having an elevation rod affixed thereto, said seat frame having an inclination rod affixed thereto, said seat frame having a plurality of seat supports attached thereto, said seat frame having a seat mounted on said seat supports, said elevation rod having a fastening rod received thereon, said fastening rod removably engageable with corresponding locating holes of said locating holes of said main posts, said inclination rod having a fitting piece and a sleeve attached to opposite ends of said inclination rod, said sleeve being slidably attached to said inclination rod, said fitting piece residing on a surface of one of said main posts, said seat of said seat frame adjustable in height by relocating said fastening rod of said elevation rod to different corresponding locating holes of said main posts, said seat of said seat frame inclinable by sliding said sleeve onto said fitting piece of said inclination rod such that a surface of said sleeve resides against the surface of one of said main posts.

* * * * *